US012318703B2

(12) United States Patent
Barnes

(10) Patent No.: US 12,318,703 B2
(45) Date of Patent: Jun. 3, 2025

(54) INTERACTIVE DOLL ASSEMBLY

(71) Applicant: Claude Barnes, Newark, NJ (US)

(72) Inventor: Claude Barnes, Newark, NJ (US)

( * ) Notice: Subject to any disclaimer, the term of this patent is extended or adjusted under 35 U.S.C. 154(b) by 367 days.

(21) Appl. No.: 17/860,535

(22) Filed: Jul. 8, 2022

(65) Prior Publication Data

US 2024/0009583 A1 Jan. 11, 2024

(51) Int. Cl.
*A63H 3/28* (2006.01)
*A63H 3/14* (2006.01)

(52) U.S. Cl.
CPC ..... *A63H 3/28* (2013.01); *A63H 3/14* (2013.01); *A63H 2200/00* (2013.01)

(58) Field of Classification Search
CPC . A63H 3/003; A63H 3/02; A63H 3/14; A63H 3/28; A63H 3/36; A63H 30/02; A63H 2200/00
USPC ..... 446/175, 297, 298, 300, 301, 327, 369, 446/484
See application file for complete search history.

(56) References Cited

U.S. PATENT DOCUMENTS 4,139,968 A * 2/1979 Milner ..... A63H 3/28 446/175
4,687,457 A * 8/1987 Milner ..... A63H 3/14 446/175
5,447,461 A * 9/1995 Liao ..... A63H 3/14 446/329
5,746,602 A * 5/1998 Kikinis ..... A63H 30/04 446/298
5,953,779 A * 9/1999 Schwartz ..... A47C 27/001 5/722
6,183,337 B1 * 2/2001 Beckman ..... A63H 3/28 446/302
6,669,527 B2 * 12/2003 Tai Chan ..... A63H 3/28 446/175
6,707,777 B1 * 3/2004 Cherry ..... G11B 31/02 446/73
6,773,344 B1 * 8/2004 Gabai ..... A63H 30/04 463/1
6,971,943 B1 * 12/2005 Schulze ..... A63H 3/14 446/175
7,662,015 B2 * 2/2010 Hui ..... A63H 33/22 446/130
8,568,189 B2 * 10/2013 Garbos ..... A63H 33/38 446/175
8,684,786 B2 * 4/2014 Chan ..... A63H 3/20 446/175
8,827,760 B2 * 9/2014 Ushibo ..... A63H 3/003 446/268

(Continued)

*Primary Examiner* — Alexander R Niconovich

(57) ABSTRACT

An interactive doll assembly for entertaining and educating a child includes a doll and a housing. A panel is attached to the doll and defines a pocket, into which the housing is selectively positionable. A battery, a microprocessor, and a receiver are attached to the housing and are positioned in an interior space defined by the housing. A speaker is attached to the housing. The microprocessor is operationally engaged to the battery, the receiver, and the speaker. Oversight programming code, which is selectively positionable on an electronic device of a user, enables the electronic device to store a plurality of audio files and user selection of a respective audio file for transmission to the microprocessor, via the receiver. The microprocessor is enabled to actuate the speaker to broadcast the audio.

7 Claims, 5 Drawing Sheets

(56) References Cited

U.S. PATENT DOCUMENTS

| | | | | |
|---|---|---|---|---|
| 9,039,482 | B2 * | 5/2015 | Cohen | A63H 30/04 446/175 |
| 9,126,122 | B2 * | 9/2015 | Boeckle | A63H 3/28 |
| 9,421,475 | B2 * | 8/2016 | Garbos | A63H 33/26 |
| 9,931,572 | B2 * | 4/2018 | Wong | A63H 30/04 |
| 10,616,310 | B2 * | 4/2020 | Watry | H04L 67/306 |
| 10,792,578 | B2 * | 10/2020 | Su | A63H 3/005 |
| 10,894,216 | B2 * | 1/2021 | Quick, III | A63H 3/48 |
| 11,213,761 | B2 * | 1/2022 | Lyell | A63H 3/001 |
| 12,053,710 | B1 * | 8/2024 | Benton | A63H 13/005 |
| 2008/0194175 | A1 * | 8/2008 | Last | G06F 3/002 446/302 |
| 2011/0021109 | A1 * | 1/2011 | Le | A63H 13/00 446/300 |
| 2013/0059284 | A1 * | 3/2013 | Giedgowd, Jr. | A63H 3/36 709/219 |
| 2016/0074760 | A1 * | 3/2016 | Parker | A63H 3/02 446/72 |
| 2016/0121229 | A1 * | 5/2016 | Guo | A63H 3/28 446/175 |
| 2018/0158458 | A1 * | 6/2018 | Weber | G10L 15/1815 |
| 2018/0168362 | A1 * | 6/2018 | Dorfman | A47C 31/123 |
| 2018/0272240 | A1 * | 9/2018 | Soudek | A63H 3/28 |
| 2020/0129874 | A1 * | 4/2020 | Culver, II | A63H 3/02 |
| 2020/0152074 | A1 * | 5/2020 | Henley | H04R 1/028 |
| 2022/0047956 | A1 * | 2/2022 | Wong | G06F 3/167 |
| 2024/0091656 | A1 * | 3/2024 | Mazzetti | A63H 3/36 |

* cited by examiner

INTERACTIVE DOLL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to doll assemblies and more particularly pertains to a new doll assembly for entertaining and educating a child. The present invention discloses a doll with a hinged jaw that can be manipulated to mimic speech and which can broadcast audio files under control of supervising adult.

(2) Description of Related Art Including Information Disclosed Under 37 CFR 1.97 and 1.98

The prior art relates to doll assemblies. The prior art discloses a variety of talking dolls. What is lacking in the prior art is a doll assembly comprising a doll, which is configured for broadcasting audio files, and oversight programming code positionable on an electronic device of a supervising adult, which allows the supervising adult to control which audio files are broadcast.

BRIEF SUMMARY OF THE INVENTION

An embodiment of the disclosure meets the needs presented above by generally comprising a doll and a housing. A panel is attached to the doll and defines a pocket, into which the housing is selectively positionable. A battery, a microprocessor, and a receiver are attached to the housing and are positioned in an interior space defined by the housing. A speaker is attached to the housing. The microprocessor is operationally engaged to the battery, the receiver, and the speaker. Oversight programming code, which is selectively positionable on an electronic device of a user, enables the electronic device to store a plurality of audio files and user selection of a respective audio file for transmission to the microprocessor, via the receiver. The microprocessor is enabled to actuate the speaker to broadcast the audio.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
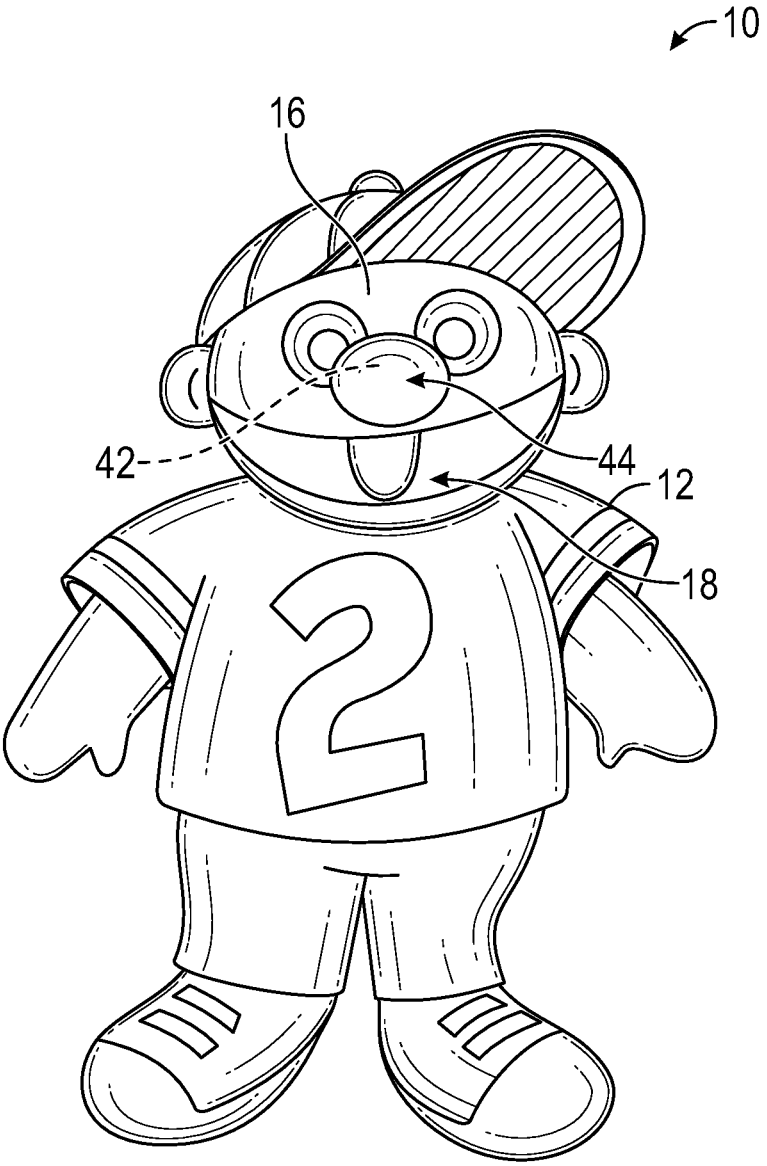
FIG. 1 is a front view of an interactive doll assembly according to an embodiment of the disclosure.

With reference now to the drawings, and in particular to FIGS. 1 through 5 thereof, a new doll assembly embodying the principles and concepts of an embodiment of the disclosure and generally designated by the reference numeral 10 will be described.

As best illustrated in FIGS. 1 through 5, the interactive doll assembly 10 generally comprises a doll 12 and a housing 14. The doll 12 comprises a head 16, which has a hinged jaw 18. An opening 20 is positioned in a back 22 of the head 16 and is configured for insertion of a hand of a user, positioning the user to manipulate the hinged jaw 18 so that the doll 12 mimics speaking.

A panel 24 is attached to the doll 12 and defines a pocket 26, into which the housing 14 is selectively positionable. As the housing 14 is selectively removable from the pocket 26, the doll 12 can be laundered.

A battery 28, a microprocessor 30, and a receiver 32 are attached to the housing 14 and are positioned in an interior space 34 defined by the housing 14. A speaker 36 and a microphone 38 are attached to the housing 14. The microprocessor 30 is operationally engaged to the battery 28, the receiver 32, the speaker 36, and the microphone 38. The battery 28 is rechargeable. A charging port 40 is attached to the housing 14 and is operationally engaged to the battery 28. The charging port 40 is configured for insertion of a charging plug of a charging cord (not shown) to charge the battery 28.

A switch 42 is positioned in a nose 44 of the doll 12 and is operationally engaged to the microprocessor 30 and the battery 28. The switch 42 is configured to be switched to operationally engage the microprocessor 30 to the battery 28. A connecting port 46 is attached to the housing 14 and is operationally engaged to the microprocessor 30 and the battery 28. A cable 48 is operationally engaged to the switch 42 and extends into the pocket 26. A connecting plug 50 is operationally engaged to the cable 48 and is positioned in the pocket 26. The connecting plug 50 is positioned for selective insertion into the connecting port 46 to operationally engage the switch 42 to the microprocessor 30 and the battery 28.

Figure 2:
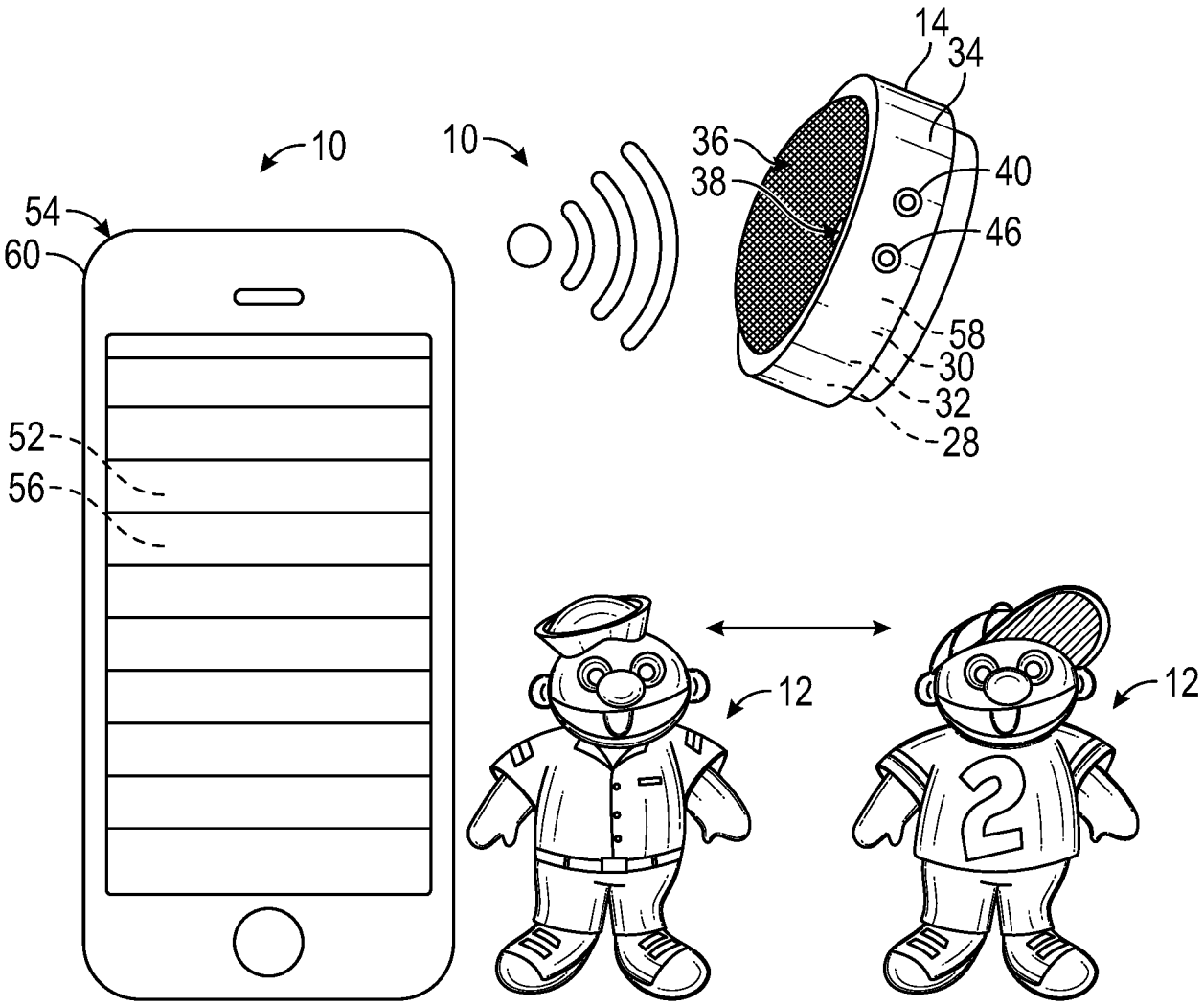
FIG. 2 is a detail view of an embodiment of the disclosure.
Figure 3:
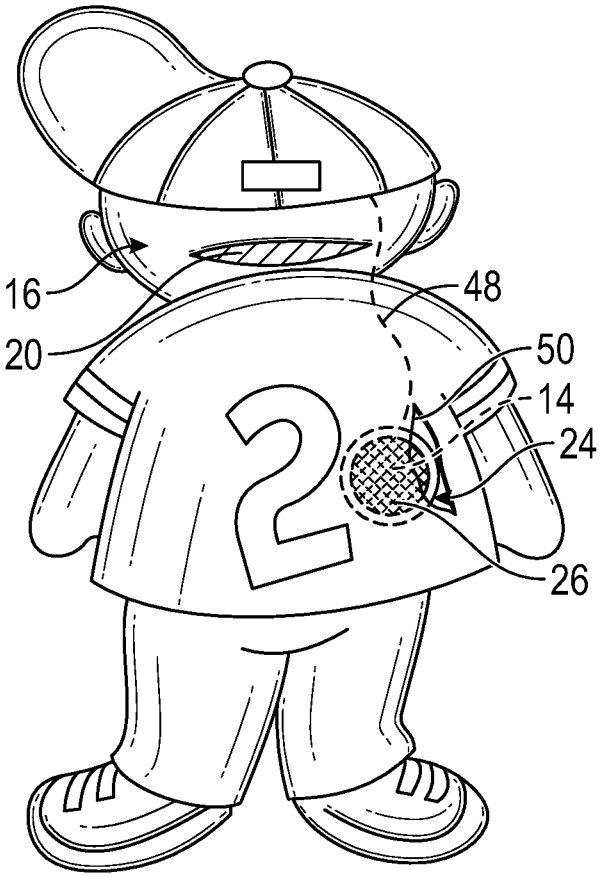
FIG. 3 is a rear view of an embodiment of the disclosure.

Oversight programming code 52, which is selectively positionable on an electronic device 54 of a user, enables the electronic device 54 to store a plurality of audio files 56 and user selection of a respective audio file 56 for transmission to the microprocessor 30, via the receiver 32. The plurality of audio files 56 comprises one or more of a book, a language lesson, a math lesson, a science lesson, a spelling lesson, a song, a joke, a riddle, a bedtime story, or the like. The microprocessor 30 is enabled to actuate the speaker 36 to broadcast the audio file 56. The oversight programming code 52 also enables the electronic device 54 to selectively pair two or more dolls 12, as shown in FIG. 2.

Recognition programming code 58, which is positioned on the microprocessor 30 enables the microprocessor 30 for voice recognition and for input of verbal commands via the microphone 38. The recognition programming code 58 enables the doll 12 to effectively greet the child upon the child's entry into its proximity and allows the child to interact verbally with the doll 12.

Figure 4:
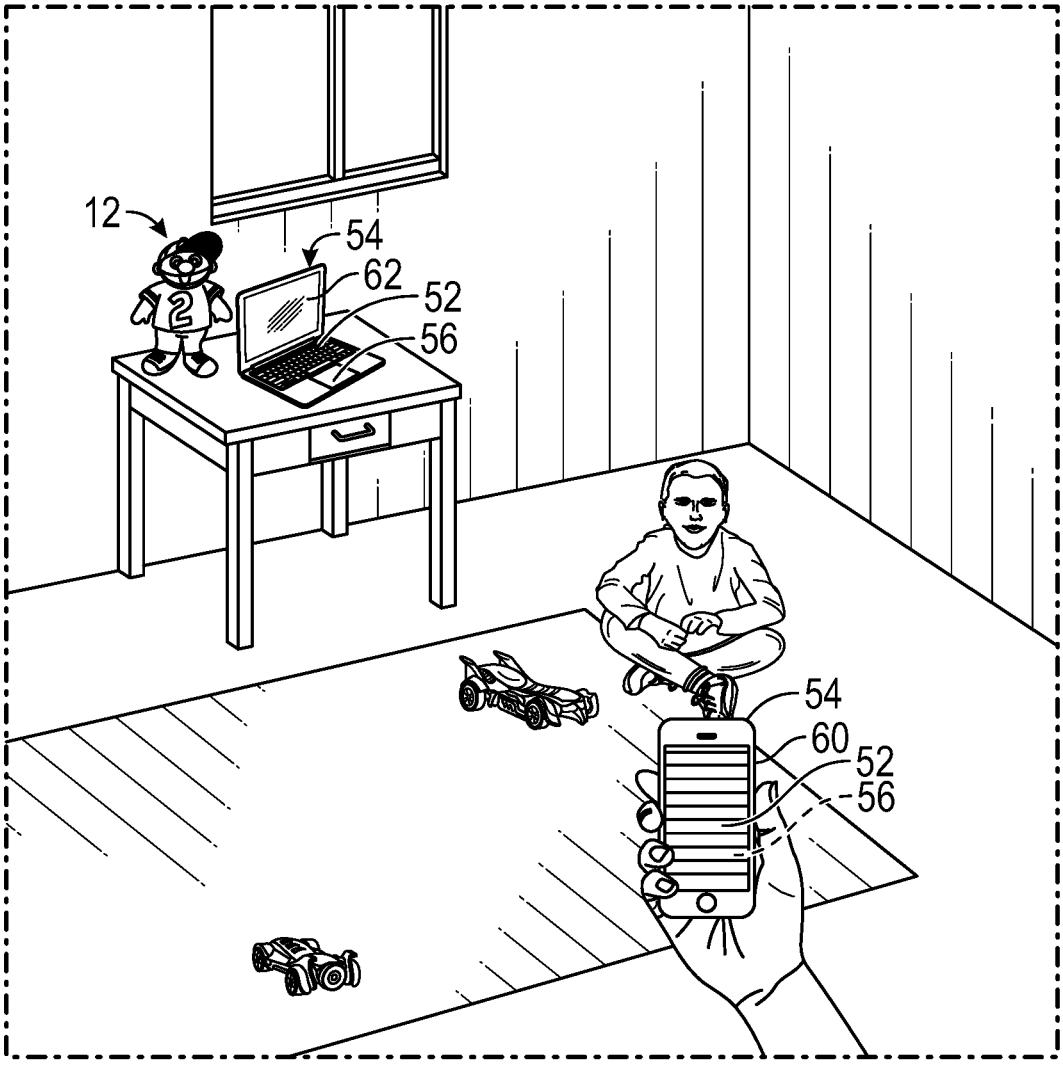
FIG. 4 is an in-use view of an embodiment of the disclosure.
Figure 5:
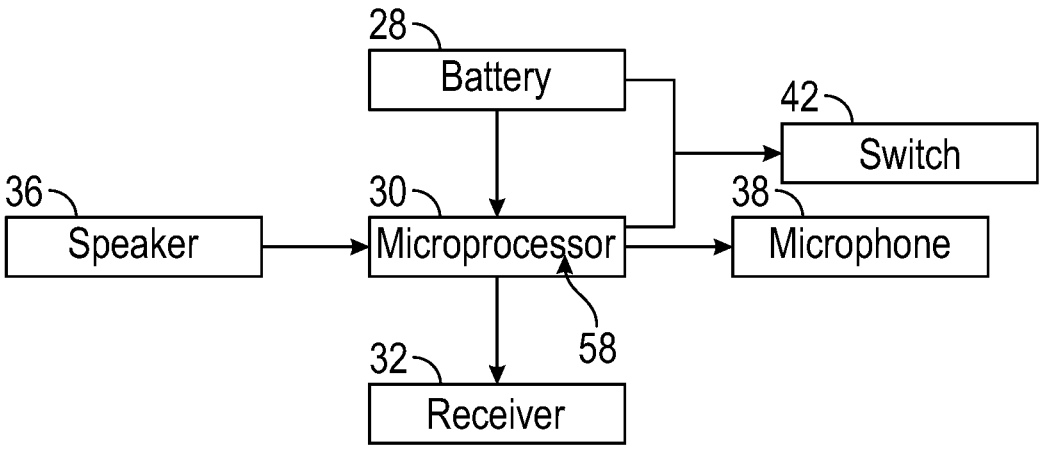
FIG. 5 is a block diagram of an embodiment of the disclosure.
Figure 5:
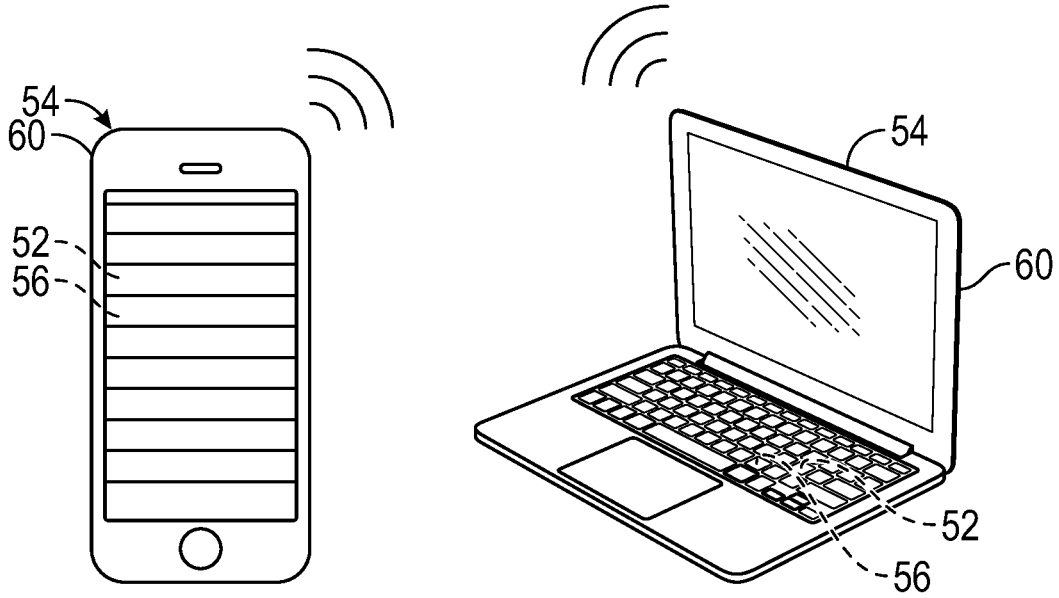

In use, a user, typically a parent, can store the plurality of audio files 56 on their electronic device 54, typically a smartphone 60 or a computer 62, as shown in FIG. 4. The user can select a book, a language lesson, a math lesson, a science lesson, a spelling lesson, a song, a joke, a riddle, a bedtime story, or the like, for broadcast by the speaker 36 for the enjoyment and education of a child.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An interactive doll assembly comprising:

a doll, the doll including a head having a hinged jaw;

an opening positioned in a back of the head, wherein the opening is configured for insertion of a hand of a user, positioning the user for manipulating the hinged jaw, such that the doll mimics speaking;

a panel attached to the doll defining a pocket;

a housing selectively positionable in the pocket, the housing defining an interior space;

a battery attached to the housing and positioned in the interior space;

a microprocessor attached to the housing, positioned in the interior space, and operationally engaged to the battery;

a receiver attached to the housing, positioned in the interior space, and operationally engaged to the microprocessor;

a speaker attached to the housing and operationally engaged to the microprocessor;

oversight programming code selectively positionable on an electronic device of a user enabling the electronic device for storing a plurality of audio files and enabling user selection of a respective audio file for transmission to the microprocessor, via the receiver, enabling the microprocessor for actuating the speaker for broadcasting the audio file; and a switch positioned in a nose of the doll proximate to and forward of the opening in the back of the head, the switch being operationally engaged to the microprocessor and the battery, wherein the switch is configured for being switched for operationally engaging the microprocessor to the battery.

2. The interactive doll assembly of claim 1, further including:

the battery being rechargeable; and a charging port attached to the housing and operationally engaged to the battery, wherein the charging port is configured for insertion of a charging plug of a charging cord for charging the battery.

3. The interactive doll assembly of claim 1, wherein the oversight programming code enables the electronic device for selectively pairing two or more dolls.

4. The interactive doll assembly of claim 1, further including:

a connecting port attached to the housing and operationally engaged to the microprocessor and the battery;

a cable operationally engaged to the switch and extending into the pocket; and a connecting plug operationally engaged to the cable and positioned in the pocket, such that the connecting plug is positioned for selective insertion into the connecting port for operationally engaging the switch to the microprocessor and the battery.

5. The interactive doll assembly of claim 1, further including;

a microphone attached to the housing and operationally engaged to the microprocessor; and recognition programming positioned on the microprocessor enabling the microprocessor for voice recognition and input of verbal commands via the microphone.

6. The interactive doll assembly of claim 1, wherein the plurality of audio files comprises one or more of a book, a language lesson, a math lesson, a science lesson, a spelling lesson, a song, a joke, a riddle, and a bedtime story.

7. An interactive doll assembly comprising:

a doll, the doll comprising a head having a hinged jaw;

an opening positioned in a back of the head, wherein the opening is configured for insertion of a hand of a user, positioning the user for manipulating the hinged jaw, such that the doll mimics speaking;

a panel attached to the doll defining a pocket;

a housing selectively positionable in the pocket, the housing defining an interior space;

a battery attached to the housing and positioned in the interior space, the battery being rechargeable;

a charging port attached to the housing and operationally engaged to the battery, wherein the charging port is configured for insertion of a charging plug of a charging cord for charging the battery;

a microprocessor attached to the housing, positioned in the interior space, and operationally engaged to the battery;

a receiver attached to the housing, positioned in the interior space, and operationally engaged to the microprocessor;

a speaker attached to the housing and operationally engaged to the microprocessor;

oversight programming code selectively positionable on an electronic device of a user enabling the electronic device for storing a plurality of audio files and enabling user selection of a respective audio file for transmission to the microprocessor, via the receiver, enabling the microprocessor for actuating the speaker for broadcasting the audio file, the plurality of audio files comprising one or more of a book, a math lesson, a science lesson, a spelling lesson, a song, a joke, a riddle, and a bedtime story, the oversight programming code enabling the electronic device for selectively pairing two or more dolls;

a switch positioned in a nose of the doll proximate to and forward of the opening in the back of the head, the switch being operationally engaged to the microprocessor and the battery, wherein the switch is configured for being switched for operationally engaging the microprocessor to the battery;

a connecting port attached to the housing and operationally engaged to the microprocessor and the battery;

a cable operationally engaged to the switch and extending into the pocket;

a connecting plug operationally engaged to the cable and positioned in the pocket, such that the connecting plug is positioned for selective insertion into the connecting port for operationally engaging the switch to the microprocessor and the battery;

a microphone attached to the housing and operationally engaged to the microprocessor; and recognition programming positioned on the microprocessor enabling the microprocessor for voice recognition and input of verbal commands via the microphone.

* * * * *